US005577402A

United States Patent [19]

Kuhrau et al.

[11] Patent Number: 5,577,402

[45] Date of Patent: Nov. 26, 1996

[54] POSITIONING GAUGES FOR A CIRCULAR SLIVER KNITTING MACHINE

[75] Inventors: Michael K. Kuhrau; Donald C. Fosselman, both of Orangeburg, S.C.

[73] Assignee: Mayer Industries, Inc., Orangeburg, S.C.

[21] Appl. No.: 540,057

[22] Filed: Oct. 6, 1995

[51] Int. Cl.[6] ..... D04B 9/14; D04B 9/06

[52] U.S. Cl. ..... 66/9 B; 66/27

[58] Field of Search ..... 66/9 B, 27

[56] References Cited

U.S. PATENT DOCUMENTS

| | | | |
|---|---|---|---|
| 672,182 | 4/1901 | Sedmihradsky . | |
| 2,255,078 | 9/1941 | Moore | 66/9 B |
| 2,280,535 | 4/1942 | Moore | 66/80 |
| 2,953,912 | 9/1960 | Hill | 66/9 B |
| 3,021,698 | 2/1962 | Hill | 66/9 B |
| 3,045,459 | 7/1962 | Hill | 66/94 |
| 3,123,991 | 3/1964 | Schmidt | 66/27 X |
| 3,226,952 | 1/1966 | Cassady | 66/9 B |
| 3,295,337 | 1/1967 | Beucus et al. | 66/9 B |
| 3,299,672 | 1/1967 | Schmidt | 66/9 B |
| 3,710,597 | 1/1973 | Schmidt | 66/191 |
| 3,728,872 | 4/1973 | Thore | 66/9 B |
| 3,757,538 | 9/1973 | Martinetz | 66/27 X |
| 4,006,609 | 2/1977 | Abler | 66/9 B |
| 4,050,267 | 9/1977 | Schaab et al. | 66/9 B |
| 4,068,496 | 1/1978 | Bourgeois | 66/27 |
| 4,187,700 | 2/1980 | Koegel | 66/111 |
| 4,244,198 | 1/1981 | Schaab et al. | 66/191 |
| 4,245,487 | 1/1981 | Schaab et al. | 66/9 B |
| 4,364,243 | 12/1982 | Kunde | 66/9 B |
| 4,532,780 | 8/1985 | Tilson et al. | 66/9 B |
| 4,563,884 | 1/1986 | Kunde et al. | 66/93 |
| 5,134,863 | 8/1992 | Hanna | 66/9 B |
| 5,431,029 | 7/1995 | Kuhrau et al. | 66/9 B |

FOREIGN PATENT DOCUMENTS

| | | |
|---|---|---|
| 1097092 | 3/1981 | Canada . |
| 1108883 | 9/1981 | Canada . |
| 2817130 | 11/1978 | Germany . |
| 710949 | 7/1966 | Italy . |
| 1528827 | of 0000 | U.S.S.R. . |
| 807049 | 1/1959 | United Kingdom . |

OTHER PUBLICATIONS

*High Tech for High Pile* (brochure), Mayer Wildman Industries, Inc. 3KPC9/87 no date.

*Primary Examiner*—John J. Calvert

*Attorney, Agent, or Firm*—Bell, Seltzer, Park & Gibson, P.A.

[57] ABSTRACT

A first and second indexing gauge for use in positioning air blowing units relative to the needles of a circular sliver knitting machine. An air blowing unit is attached to the machine so as to be both vertically and rotationally adjusted relative to the knitting cylinder. Once the machine has been initially calibrated, the first and second indexing gauges can be used to quickly and easily reposition the air blowing units relative to the needles so as to allow the machine to knit a different fabric and/or pattern with minimal down time and wasted raw materials.

24 Claims, 4 Drawing Sheets

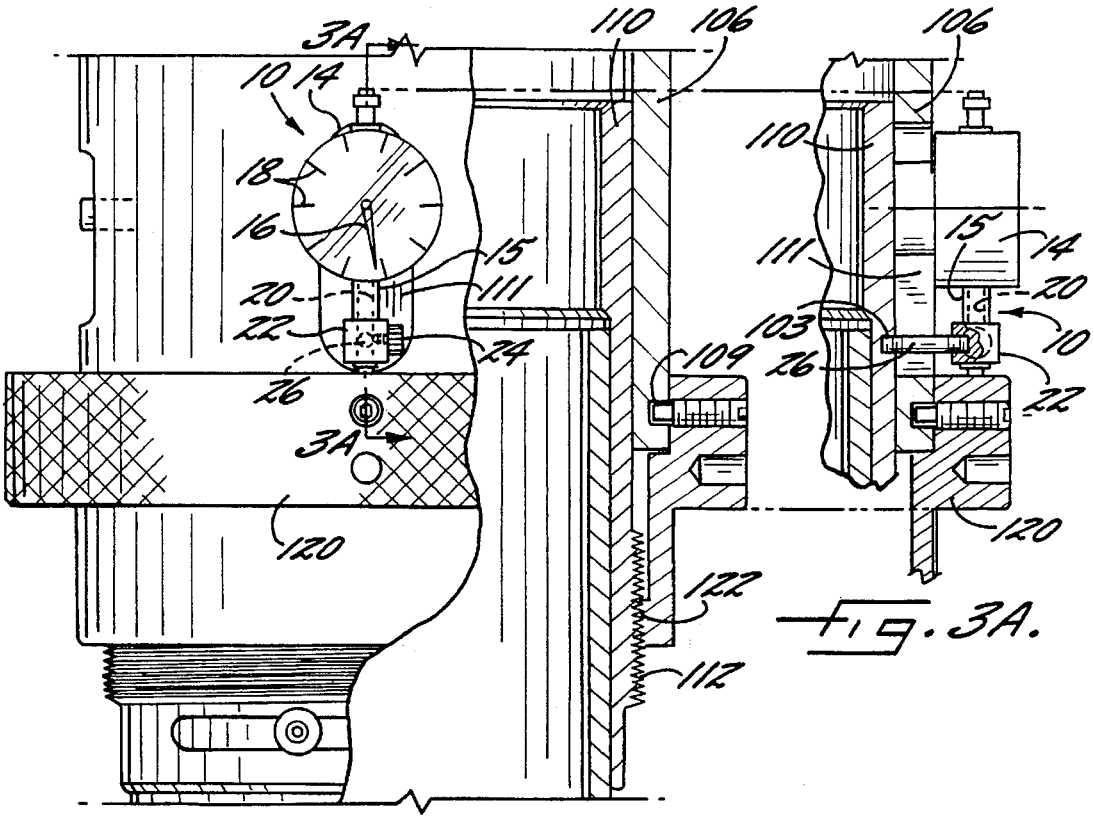
Fig. 3.
Fig. 3A.
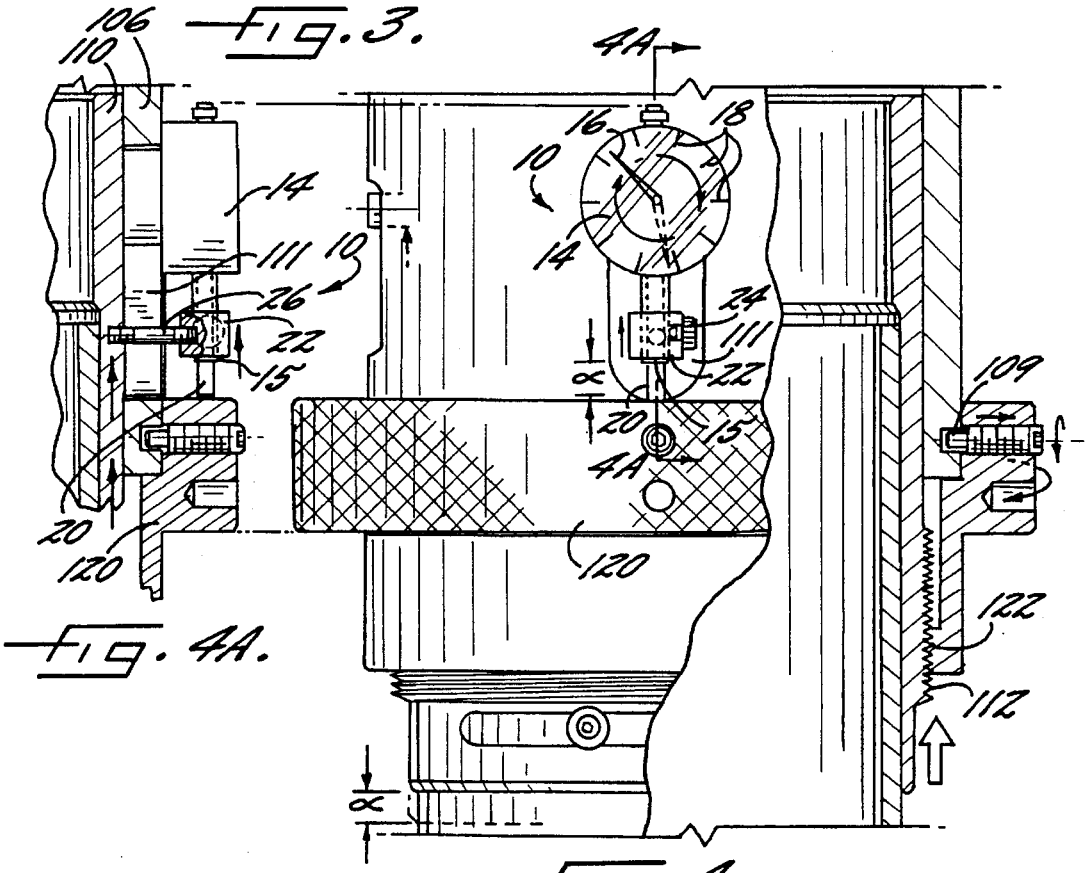
Fig. 4A.
Fig. 4.

POSITIONING GAUGES FOR A CIRCULAR SLIVER KNITTING MACHINE

FIELD OF THE INVENTION

The present invention relates to the field of sliver knitting, and, more particularly to, an indexing gauge for readily positioning the air blowing units relative to the plurality of needles of a circular sliver knitting machine for manufacturing sliver knit fabric in predetermined patterns.

BACKGROUND OF THE INVENTION

The manufacture of reverse loop sliver knit fabric using a circular sliver knitting machine for producing a pile fabric is well known in the art. For example, Schaab et al. in U.S. Pat. Nos. 4,244,198 and 4,245,487 and U.S. Pat. No. 5,431,029 to Kuhrau et al. which have been assigned to the applicant of the present invention each disclose a method and apparatus for making reverse loop sliver knit fabric which uses an air nozzle positioned radially inward from the needles and sinkers. The purpose of the air nozzle is to turn the free ends of the sliver, previously knitted into the base fabric during the first pass of the needles, over the sinkers so that the remaining free ends, assuming that they are of sufficient length, will be knitted a second time or interlaced into the fabric. The result is that the length of the free ends remaining after the second pass is shortened and as a consequence, the pile will be shorter, therefore, less waste will occur as result of shearing. The Kuhrau et al. patent introduced the ability to use the air nozzle to help the needles capture and retain the free ends of the sliver for purposes of interlacing them into the fabric. As a consequence, the resultant fabric has a uniform length without requiring shearing of a large portion of the pile prior to use.

Prior to the Kuhrau et al. patent, it was necessary to individually calibrate the position of every air nozzle unit relative to the needles individually before the machine was ready to produce a commercially usable fabric. Unfortunately, after each such adjustment, it was necessary to run the machine to determine if the positioning of every air nozzle unit was proper. This approach to calibration resulted in a great deal of down time and wasted materials every time a new fabric and/or pattern was to be knit.

Kuhrau et al. disclosed a circular sliver knitting machine which used an adjustable support ring to carry the air nozzle units. To calibrate a machine to accommodate a change in fabric and/or pattern to be knit required the calibration of only one air nozzle unit. Then all the other air nozzle units were calibrated as to their vertical and rotational position because of their connection to the adjustable support ring.

However, it is still necessary to manually calibrate, by means of the adjustable support ring, one air nozzle unit every time the machine is to knit a different fabric and/or pattern. Because even minor adjustments in the vertical and/or rotational position of the air nozzle units relative to the needles has a dramatic effect on the quality and nature of the fabric, significant time is still required to manually adjust the air nozzle units and some waste of raw materials still occurs.

SUMMARY OF THE INVENTION

In view of the foregoing background, it is therefore an object of the present invention to provide a circular sliver knitting machine which can readily be adjusted so as to knit a series of predetermined patterns by reliance on an indexing means which corresponds to the position of the air blowing units relative to the plurality of needles.

These and other objects, features and advantages of the present invention are obtained by providing a circular sliver knitting machine having a frame which rotatably support a needle cylinder. A plurality of needles are supported in said needle cylinder for rotational movement therewith and for vertical movement parallel to the axis of rotation thereof. A plurality of card units are provided at radially spaced locations along the rotational path of the needle cylinder. Each card unit is positioned to deliver sliver fibers to the needles during their rotation with the needle cylinder. A yarn feeding station is positioned adjacent each of the card units for selectively feeding yarn to the plurality of needles. A plurality of sinkers are also provided which cooperate with the plurality of needles to form the yarn and the sliver fibers into knitted fabric.

The circular sliver knitting machine is also provided with an air blowing unit which cooperates with each of the plurality of card units for blowing air along a path generally radially outward toward the plurality of needles for turning free ends of the sliver fiber over onto the plurality of sinkers.

The air blowing unit of the present invention includes an air nozzle, an air supply hose, and a mounting assembly which combine to define an air passageway for blowing or directing air onto the plurality of needles. The mounting assembly is attached to the circular sliver knitting machine so that the mounting assembly may be moved to control the horizontal distance between the air nozzle and the plurality of needles. In addition, the nozzle can be selectively rotatably movable about the nozzles longitudinal axis for selective adjustment of its rotational orientation relative to the plurality of needles.

The present invention also facilitates simultaneous movement of the air blowing unit relative to the plurality of needles. The initial calibration or adjustment of the air unit relative to the plurality of air nozzles in the horizontal and rotational direction having been previously described, it is also necessary for production of quality fabric and for producing various kinds of fabric to vary the lateral and the longitudinal or elevational relationship of the air blowing unit relative to the plurality of needles. To make such adjustments for each individual air blowing unit under current techniques is both relatively time consuming and still results in some wasted material. Accordingly, it is preferable from a cost and time saving perspective to be able to simultaneously adjust all air blowing units relative to the plurality of needles.

In the present invention, this is achieved by an adjustment means having a support ring, adapted to receive the air blowing units. The support ring is cast or formed with an exhaust hood which forms a suction means. An indexing means is provided such that the indexing means cooperates with the adjustment means to allow for the quick and efficient adjustment of the air nozzle units of the blowing units relative to the plurality of needles once the initial calibration has been done. As a result, changing the machine to knit a different fabric and/or pattern can be quickly achieved without the heretofore associated waste of time and raw materials.

The indexing means comprises a first indexing gauge which has a body attached to the suction means and has a plunger biased outwardly therefrom. The plunger and body of the first indexing means are movable relative to one another to indicate the corresponding vertical adjustment of the air blowing units relative to the plurality of needles.

The second indexing gauge also cooperates with the suction means such that a scale having incremental markings is mounted to one of the exhaust hood or the tubular sleeve and a reference pointer is connected to the other of the exhaust hood and the tubular sleeve, generally transverse to the scale, i.e., parallel to the incremental marks thereof, so that the scale and the reference pointer can move relative to each other to indicate the rotational position of the air blowing units relative to the plurality of needles.

The suction means sucks waste fiber laden air from a region of the circular sliver knitting machine radially inward from the air blowing units. The preferred arrangement is for the exhaust hood to have a tube adjusting portion affixed thereto. The tube adjusting portion and the exhaust hood desirably contain corresponding horizontal grooves along a predetermined distance thereof which enables lateral movement of the exhaust hood relative to the tube adjusting portion. A tightening means is received within the horizontal grooves for selectively tightening the exhaust hood in a predetermined position relative to the tube adjusting portion.

In addition, it is beneficial for the tube adjusting portion to have a threaded outer surface. An attachment portion is attached at one end to the bottom of the air directing means and at the other end to the tube adjusting portion. An adjusting ring control the adjusting system by having a first end longitudinally fixed and rotatably engaging the tube adjusting portion, and having a second end threadingly cooperating with a threaded outer surface of the tube adjusting portion for adjusting longitudinal movement of the exhaust hood in response to rotational movement of the adjusting ring relative to the tube adjusting portion. It is this movement of the exhaust hood both laterally and vertically which moves the support ring attached thereto, which in turn simultaneously moves the blowing units to the desired position relative to the plurality of needles.

BRIEF DESCRIPTION OF THE DRAWINGS

Some of the objects, features and advantages of the present invention having been stated, others will appear as the description proceeds, when taken in conjunction with the accompanying drawings in which;

FIG. 3 is an enlarge front view partially in cross section showing the first indexing gauge in an extended (i.e., low) position in accordance with the present invention;

FIG. 3A is a side view partially in cross section showing the first indexing gauge shown in FIG. 3;

FIG. 4 is an enlarged front view partially in cross section similar to that shown in FIG. 3 shown in the first indexing gauge in a compressed (i.e., high) position;

FIG. 4A is a side view partially in cross section showing the first indexing gauge shown in FIG. 14;

DESCRIPTION OF THE PREFERRED EMBODIMENT

The present invention will now be described more fully hereinafter with reference to the accompanying drawings, in which the preferred embodiment of the invention is shown. This invention may, however, be embodied in different forms and should not be construed as limited to the embodiments set forth herein. Rather, the illustrative embodiment is provided so that this disclosure will be thorough and complete, and will fully convey the scope of the invention to those skilled in the art. Like numbers refer to like elements throughout.

Overview Of The Circular Sliver Knitting Machine

Figure 1:
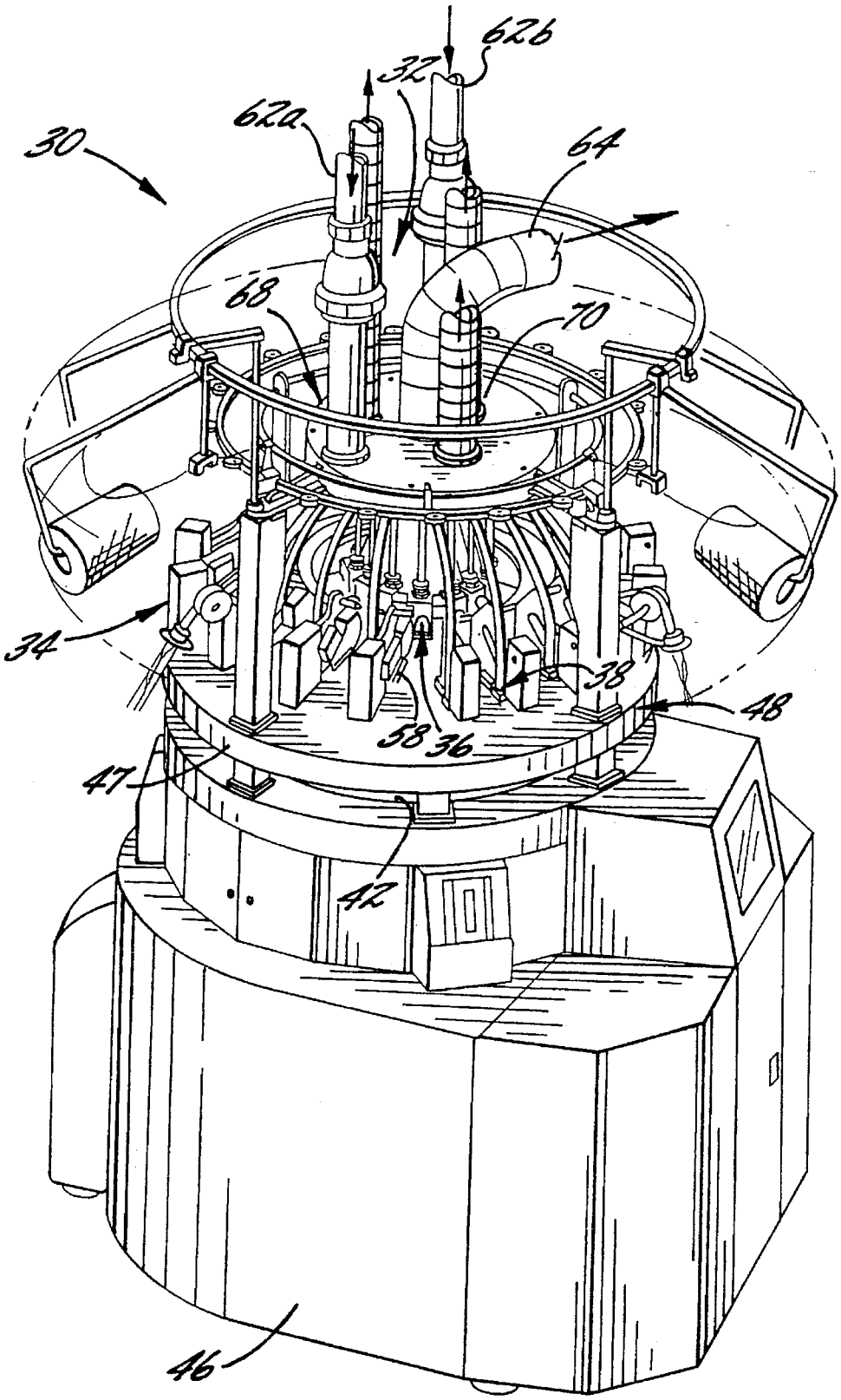
FIG. 1 is a perspective view of the apparatus in accordance with the present invention.
Figure 2:
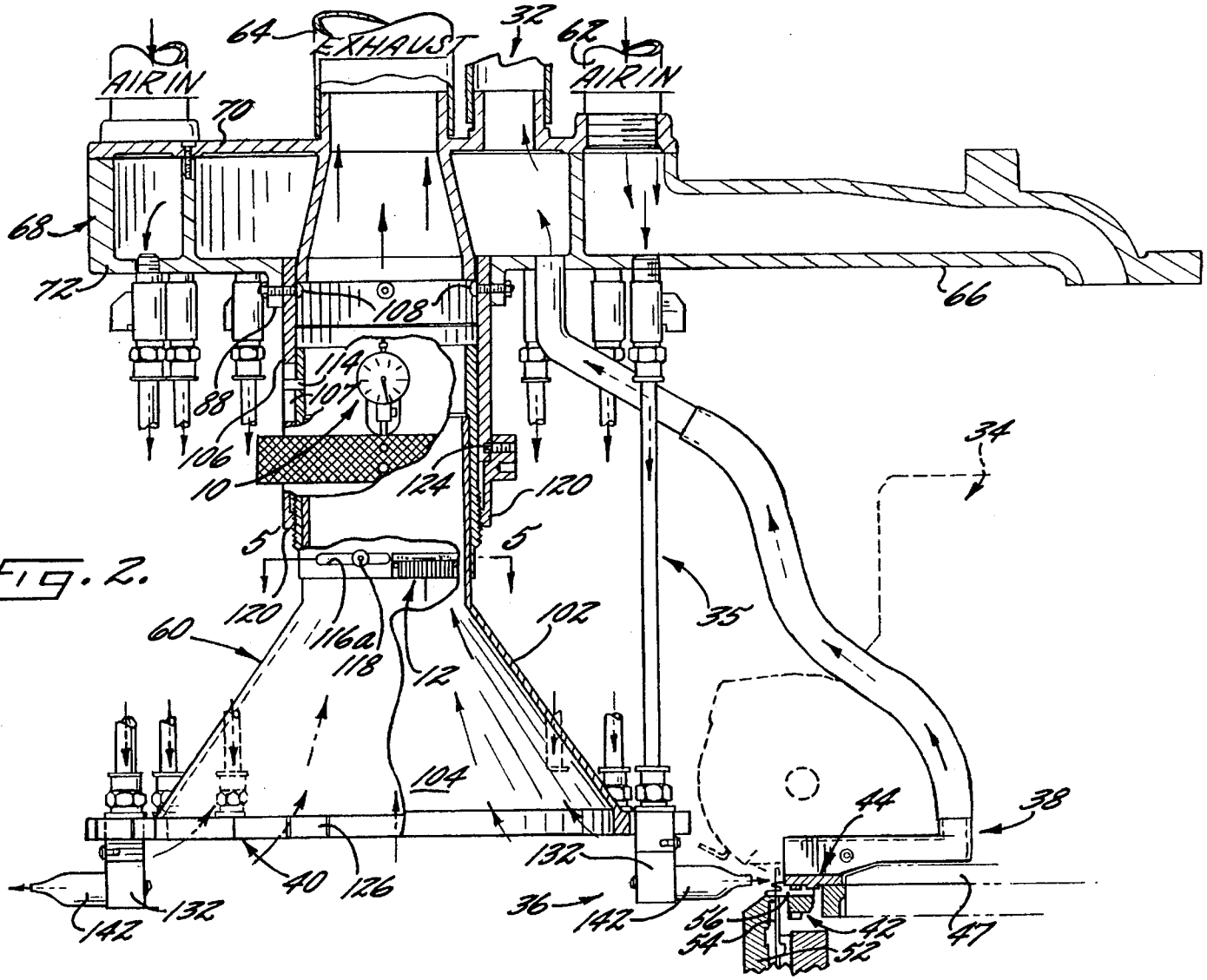
FIG. 2 is a partial cross sectional view of a portion of the circular sliver knitting machine of FIG. 1 showing the first and second indexing gauges in accordance with the present invention.

Referring to FIGS. 1 and 2, a circular sliver knitting machine which embodies the features of the present invention is illustrated generally at 30. The components of the machine 30 and the method of knitting the sliver into a reverse loop fabric is disclosed in U.S. Pat. No. 5,431,029 to Kuhrau et al. which is incorporated herein.

The machine 30 consists of an air directing assembly 32, a plurality of card units 34, a plurality of air blowing units 36, a plurality of first suction units 38, an adjustment assembly 40, and a sinker units/latch guard assembly 44. The machine 30 also includes a base 46 which supports the above recited elements on a frame 48 consisting of six substantially equally spaced stanchions 51 extending upwardly from the base 46 to support a card support ring 47 and a frame plate 42 mounted thereto.

A needle cylinder 52 is rotatably mounted to the machine 30 for rotatably carrying a plurality of needles 54 about an axis parallel to the longitudinal axis of the machine. The needles 54, revolving with the needle cylinder 52, move vertically along a predetermined sinusoidal or wave-like path relative to the card units 34, the blowing units 36, the first suction units 38, and the sinker units/latch guard assembly 44 which are each positioned in spaced locations around the machine 30. The needles 54 are movable between a welt position or clearance level and a knit position or cast-off level. In addition, the needles 54 used in the machine 30 have a short latch, thereby shortening the distance between the needles and the sinker units and latch guard assembly 44.

A plurality of sinkers 56 move generally perpendicular to the vertical movement of the needles 54 and cooperate therewith. Mounted on the frame 48 adjacent each of the card units 34, which feeds sliver fiber X to the needles 54 is a yarn feeding station 58 which feeds yarn Y to the needles 54. An exhaust unit 60 is provided for drawing or sucking fiber waste generated during the manufacturing process, out of the machine 30.

The Air Directing Assembly

The air distributing assembly 32 of the machine 30 is best seen in FIGS. 1 and 2. The air distributing assembly 32 includes an air supply, which is represented by air pipes 62*a* and 62*b*. The air pipes 62*a* and 62*b* are attached to an air pump (positive displacement unit) or fan unit (not shown) which provides air to the machine 30 at a predetermined pressure. An air discharge mechanism, represented by discharge conduit 64 in FIGS. 1 and 2 cooperates with a vacuum motor for sucking or drawing fiber waste laden air from the machine 30.

Both the air pipe 62 and the discharge conduit 64 cooperate with a manifold 66 which directs the air flow from the air pipe into the machine 30 and directs fiber waste laden air to the discharge conduit for removal from the machine. The manifold 66 is formed from a cross bar 68 and a cover 70.

The Exhaust Unit

The exhaust unit 60 is best shown in FIGS. 1 through 5. The exhaust unit 60 includes an exhaust hood 102 which has a generally funnel shape defining a hood opening 104 for sucking fiber waste laden air from the area of the machine 30 radially inward from the blowing units 36. The exhaust unit 60 is secured by an attachment sleeve 106 to the attachment flange 88 of the cross bar 68, by means of fasteners 108. A vertical slot 107 of predetermined length is formed along a portion of the attachment sleeve 106 and a horizontal slot 109 traversing the circumference of the attachment sleeve, is located below the vertical slot 107. Located in between the exhaust hood 102 and the attachment sleeve 106 is a tubular sleeve 110. The tubular sleeve is longitudinally movable relative to the attachment sleeve 106.

The tubular sleeve 110 has a threaded outer surface 112 and located above and projecting outward from the threaded outer surface, is a pin 114. The pin 114 is positioned so as to prevent the exhaust unit 60 from rotating. In addition, the pin 114 also limits the vertical travel of the tubular sleeve 110 relative to the attachment sleeve 106. The tubular sleeve 110 also has a horizontally groove **116*a* of predetermined length along its outer surface. In this embodiment, the groove 116*a* is located below the threaded outer surface 112. A corresponding threaded hole 116*b* is located on the exhaust hood 102. A tightening screw 118 is used to selectively release or tighten the exhaust hood 102 relative to the tubular sleeve 110. By loosening the screw 118, the exhaust hood 102 may be rotated within the predetermined distance about a longitudinal axis parallel to the axis of the plurality of needles 54**.

An adjusting ring 120 has a threaded end 122, which threadingly engages the threaded outer surface 112 of the tubular sleeve 110. A set screw 124 located at the other end of the adjusting ring 120, which cooperates with the horizontal slot 109 in the attachment sleeve 106. The threaded end 122 and the set screw 124 cooperate to join the adjusting ring 120 with the tubular sleeve 110 and the attachment sleeve 106.

To adjust the vertical height or elevation of the exhaust hood 102, set screw 124 is loosened, and the adjusting ring 120 is rotated in either the clockwise (to raise) or counterclockwise (to lower) direction. As the adjusting ring 120 is rotated, the set screw tracks within the horizontal slot 109 of the adjustment sleeve 106, preventing relative vertical movement therebetween, while enabling the threaded end 122 of the adjusting ring to rotate along the threaded outer surface 112 of the tubular sleeve 106. Vertically fixing the adjusting ring 120, relative to the attachment sleeve 106, allows the tubular sleeve 110 and the exhaust hood 102, which is attached thereto by the tightening screw 118, to be vertically adjusted as threaded end of the adjusting ring engage the threaded outer surface 112 of the tubular sleeve 110. The range of vertical movement is controlled by the length of the vertical slot 107, in which the pin 114 travels until encountering the end of the vertical slot.

A support ring 126 is cast or formed with the flared head of the exhaust hood 102 to form a unitary structure. Therefore, the exhaust hood 102 and the support ring 126 move together as a single unit. The support ring 126 has a plurality of U-shaped notches 128 located in spaced relation about its peripheral surface. The notches 128 receive the air blowing units 36 described in detail below. Adjacent each of the notches 128 is a mounting aperture 130 for adjustably mounting the air blowing units 36. The rotational adjustment of the exhaust hood 102 relative to the tubular sleeve 110 results in a lateral displacement or movement of each air blowing unit 36, by virtue of being mounted on the support ring 126, relative to the needles 54 of at least three inches. The threads on the outer threaded surface 112 of the tubular sleeve 110 and the threaded end 122 of the adjusting ring 120 are very fine such that movement of the exhaust hood 102 and the support ring 126 attached thereto, results in a maximum vertical adjustment of the air blowing units 36, relative to the needles 54, of at least one inch. Therefore, it may be seen that any adjustments made to the air blowing units 36 are very fine. Although the adjustments are very fine, any adjustment to the air blowing units 36 has a dramatic effect on the quality and nature of the reverse loop sliver knit fabric being produced. Accordingly, the ability to simultaneously move all of the air blowing units 36 relative to the needles 54 is a major improvement, in time and cost savings over past techniques which required individual adjustment of each air blowing unit.

The Air Blowing Units

The present invention incorporates an air blowing unit 35 which is best seen in FIGS. 1 and 2. The blowing air unit 35 comprises an air nozzle unit 36 which includes a mounting assembly generally indicated as 132 has a generally rectangular configuration wherein a longitudinal axis thereof is generally parallel to the plurality of needles 54. A first mounting member 134 has a mounting flange 136 for mounting the mounting assembly 132 to the support ring 126. Within the mounting flange 136 is defined a horizontal adjustment slot 138 which cooperates with the mounting aperture 130 of the support ring 126 for receiving a fastener 140. The cooperation between the fastener 140 and the mounting flange 136 enables the block to be horizontally adjusted for controlling the radial distance between an air nozzle 142 and the plurality of needles 54. Once the desired distance therebetween has been achieved, the fastener 140 is tightened to secure the mounting assembly 132 in place. The maximum distance between the air nozzle 142 and the needles 54 is approximately one inch. Accordingly, any horizontal adjustment to air nozzle 142 must be within this limited range.

In addition to being able to control the distance between the air nozzle 142 and the needles 54, by means of the cooperation between the mounting flange 136, the horizontal adjustment slot 138, and the fastener 140, the pivotal or rotational orientation of the air nozzle may also be adjusted relative to the needles.

The Indexing Gauges

Indexing means in the form of a first indexing gauge 10 and a second indexing gauge 12 is provided to assist in calibrating the machine 30 so as to position the air blowing units 35 in the desired location relative to the plurality of needles 54.

As shown in FIGS. 2 through 4A, the first indexing means 10 has a generally circular body 14 having a sleeve 15 extending outwardly therefrom. A rotatable dial 16 is centrally mounted within the body 14. Radially arranged around the dial 16 is a scale of predetermined increments (in this embodiment the distance between two adjacent increments is 1 mm). A spring loaded plunger 20, partially housed within the sleeve 15, projects outward from the body 14 and rests on the adjustment ring 120. The indexing gauge 10 has an adjustable bracket 22 fixedly positioned on the sleeve 15 by a set screw 24. A travel pin 26 extends outwardly from the bracket 22 generally transverse to the longitudinal axis of the plunger 20 and is seated in an opening 103 in the tubular sleeve 110. The pin 26 is positioned within an elongated slot 111 formed in the attachment sleeve 106.

As set forth above, vertical adjustment of the air blowing units 35 relative to the needles 54 causes the exhaust hood 102 and the tubular sleeve 110 to move as a unit relative to the attachment sleeve 106. Consequently, the pin 26, the bracket 22 to which the pin is attached, and the body 14 travel with the exhaust hood 102 and the tubular sleeve 110 relative to the plunger 20, fixedly positioned into contact with the adjustment ring 120. As the exhaust hood 102 and the tubular sleeve 110 travel, the pin 26 travels within the slot 111, thereby causing the bracket 22 and the body 14 (assuming the travel of the exhaust hood 102 and the tubular sleeve 110 is in the upward direction as shown by comparing FIGS. 3 and 4) to move upward relative to the plunger 20. This upward movement of the bracket 22 and the body 14 in turn causes the dial 16, located within the body and cooperating with the plunger 20, to begin to rotate in a clockwise direction along the scale 18. The amount of movement of the dial 18 corresponds to the amount of vertical movement of the blowing units 35 relative to the plurality of needles 54. Assuming the exhaust hood 102 and the tubular sleeve 110 are lowered (i.e., moved downward), relative to the attachment sleeve 106, the downward movement of the bracket 22 and the body 14 relative to the plunger 20, will result in counterclockwise movement of the dial 16 relative to the scale 18. The amount of movement of the dial 18 again corresponds to the amount of vertical movement of the blowing units 35 relative to the plurality of needles 54.

It is to be understood that the increments of the scale and the disclosed design are merely presented for illustrative purposes. Several other embodiments of the scale are readily identifiable by those skilled in the art to which this invention pertains.

Figure 5:
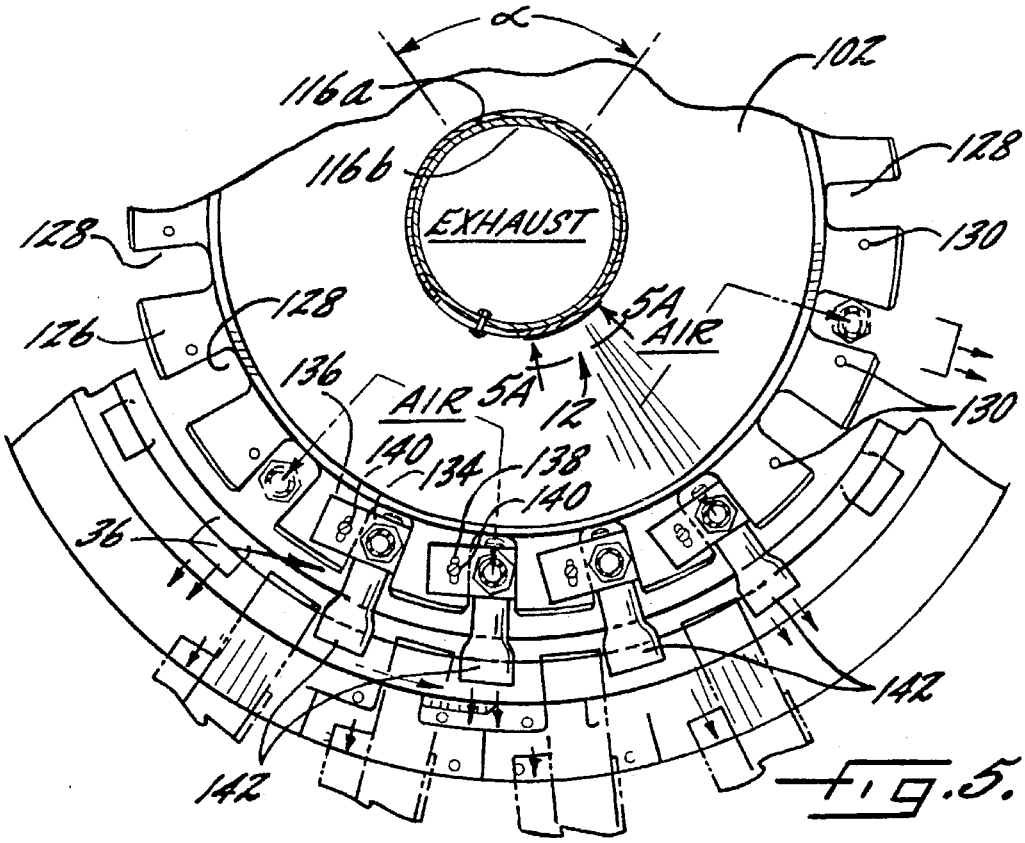
FIG. 5 is a top plan view of the exhaust hood, the support ring, and the second indexing gauge showing the rotational movement of the support ring relative to the needle cylinder.
Figure 5A:
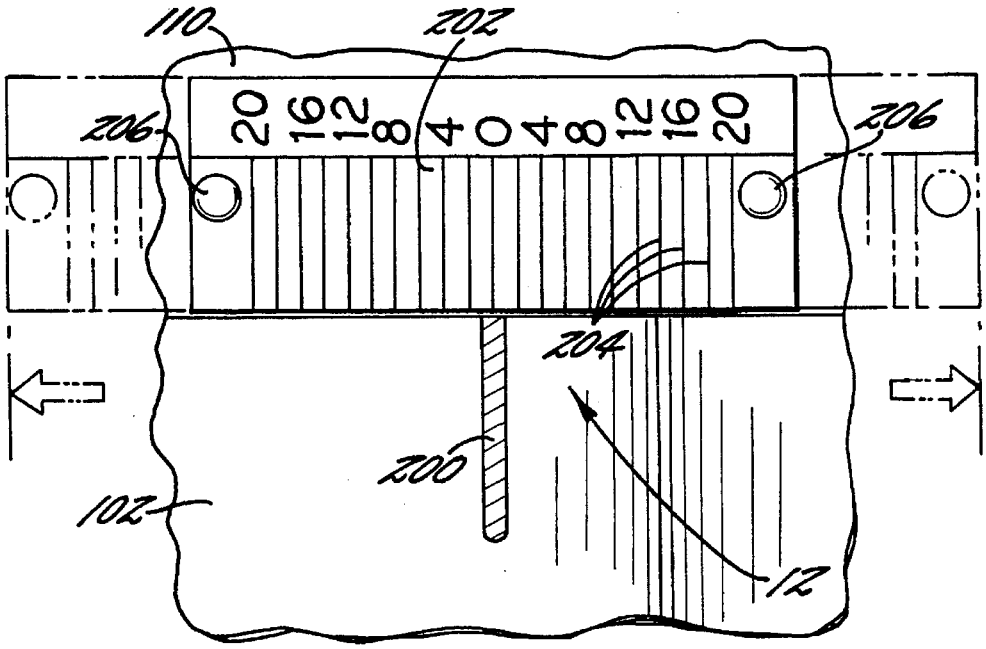
FIG. 5A is an enlarged front view of the second indexing gauge taken along the line 5A—5A of FIG. 5.

The second indexing gauge 12 is best shown with reference to FIGS. 5 and 5A. A reference pointer 200 is positioned on the exhaust hood 102. In the embodiment shown, the reference pointer 200 is etched or stamped into the surface of the exhaust hood 102 in general parallel alignment with the needles 54. Paint is applied to assist in visually locating the reference pointer 200, i.e., help it stand out from the remainder of the machine.

A scale 202 having incremental markings 204 representing graduations of 2 mm, is centrally fastened by fasteners 206, such as rivets, to the tubular sleeve 110 in a location generally transverse to the reference pointer 200. As the exhaust hood 102 is rotated relative to the tubular sleeve 110 so as to rotate the air blowing units 35 relative to the plurality of needles 54, the reference pointer 200 and the scale 202 correspondingly move relative to one another to indicate the rotational position of the blowing air units relative to the needles.

Once the air nozzle units 36 have initially been calibrated, i.e., positioned relative to the needles 54, for each of the desired fabrics and patterns this information is recorded. When the machine 30 is to be changed from knitting one pattern and/or fabric to a different pattern and/or fabric the air blowing units 35 are adjusted to the previously calibrated location by relying on the first and second index gauges 20 and 22. As a result of this ability to readily locate the preferred position for the air blowing units 35 relative to the needles 54, the amount of down time and associated waste of raw materials is significantly decreased. Consequently, knitting companies can quickly and efficiently change over their machines to accommodate customer demands.

Many modifications and other embodiments of the invention will come to mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

What is claimed is:

1. A circular sliver knitting machine comprising:

a frame;

a needle cylinder rotatably supported on said frame;

a plurality of needles supported in said needle cylinder for rotational movement therewith and for vertical movement parallel to the axis thereof;

a plurality of card units at radially spaced locations along the rotational path of said needle cylinder, to deliver sliver fibers to said needles during the movement thereof;

a yarn feeding station adjacent each of said card units for feeding yarn to said needles;

a plurality of sinkers cooperating with said needles for forming the yarn and the sliver fibers into knitted fabric;

an air blowing unit cooperating with each of said card units for blowing air along a path generally radially outward toward said needles;

adjustment means cooperating with said air blowing unit to allow for said air blowing unit to be adjustably positioned relative to said plurality of needles; and indexing means cooperating with said adjustment means for indexing the position of said air blowing unit relative to said plurality of needles for purposes of readily locating a desired position for said air blowing unit relative to said plurality of needles corresponding to one of a predetermined number of knit patterns prior to knitting.

2. A circular sliver knitting machine according to claim 1 further comprising suction means for removing waste laden air from the circular sliver knitting machine, said suction means comprising:

an exhaust hood for sucking fiber waste laden air from a central portion of the circular sliver knitting machine, said exhaust hood having a flared bottom portion defining a hood opening adapted to receive fiber waste laden air; and attachment means for adjustably attaching said exhaust hood to the circular sliver knitting machine.

3. A circular sliver knitting machine according to claim 2 wherein said adjustment means comprises a generally circular support ring carried by said exhaust hood, said air blowing unit being mounted to said support ring for orienting said air blowing unit relative to said plurality of needles, and said support ring being mounted for movement with said exhaust hood for adjusting said support ring and said air blowing unit relative to said plurality of needles.

4. A circular sliver knitting machine according to claim 3 wherein said exhaust hood and support ring are adjustable relative to said plurality of needles in both a vertical and rotational direction.

5. A circular sliver knitting machine according to claim 4 wherein said indexing means comprises a first indexing gauge for indexing the vertical position of said air blowing unit relative to said plurality of needles and a second indexing gauge for indexing the rotational position of said air blowing unit relative to said plurality of needles.

6. A circular sliver knitting machine according to claim 5 wherein said first indexing gauge comprises a body connected to said suction means and a plunger extending outwardly therefrom, wherein vertical adjustment of said air blowing unit relative to said plurality of needles results in relative longitudinal movement of said plunger and said body so as to indicate the vertical position of said air blowing unit relative to said plurality of needles.

7. A circular sliver knitting machine according to claim 6 wherein said first indexing gauge further comprises a dial located within said body, said dial rotatable about a radially arranged scale corresponding to predetermined increments, such that relative longitudinal movement of said plunger and said body causes rotation of said dial about said radially arranged scale.

8. A circular sliver knitting machine according to claim 6 wherein said second indexing gauge comprises a scale with incremental markings connected to one of said exhaust hood and said attachment means, and a reference pointer located generally transverse to said scale on the other of said exhaust hood and said attachment means, wherein pivotal movement of said exhaust hood relative to said attachment means results in relative movement of said reference pointer and said scale so as to indicate the rotational position of said air blowing unit relative to said plurality of needles.

9. A circular sliver knitting machine comprising:

a frame;

a needle cylinder rotatably supported on said frame;

a plurality of needles supported in said needle cylinder for rotational movement therewith and vertical movement parallel to the axis of rotation thereof;

a plurality of card units at radially spaced locations along the rotational path of said needle cylinder to deliver sliver fibers to said needles during the movement thereof;

a yarn feeding station adjacent each of said card units for feeding yarn to said needles;

a plurality of sinkers cooperating with said needles for forming the yarn and the sliver fibers into knitted fabric;

an exhaust hood for sucking fiber waste laden air from a central portion of the circular sliver knitting machine;

an air blowing unit connected to said exhaust hood and cooperating with each of said card units for blowing air along a path generally radially outward toward said needles;

means for adjusting said exhaust hood so as to selectively adjust said air blowing unit relative to said plurality of needles; and indexing means cooperating with said adjustment means for indexing the position of said plurality of air blowing unit relative to said plurality of needles for purposes of readily locating a desired position for said plurality of air blowing unit relative to said plurality of needles corresponding to one of a predetermined number of knit patterns prior to knitting.

10. A circular sliver knitting machine according to claim 9 wherein said adjustment means comprises a generally circular support ring carried by said exhaust hood, said air blowing unit being mounted to said support ring for orienting said air blowing unit relative to said plurality of needles, and said support ring being mounted for movement with said exhaust hood for adjusting said support ring and said air blowing unit relative to said plurality of needles.

11. A circular sliver knitting machine according to claim 9 further comprising attachment means for attaching said exhaust hood to the circular sliver knitting machine, wherein said attachment means comprises:

a tubular sleeve attached to said exhaust hood and said tubular sleeve having a threaded outer surface;

an attachment sleeve attached to the circular sliver knitting machine; and an adjusting ring having a first end longitudinally fixed and rotatably engaging said attachment sleeve for connecting said exhaust hood thereto, said adjusting ring having a second end threadingly cooperating with said threaded outer surface of said tubular sleeve, wherein rotational movement of said adjusting ring about said attachment sleeve and along said threaded outer surface of said tubular sleeve enables longitudinal adjustment of said exhaust hood.

12. A circular sliver knitting machine according to claim 11 further comprising:

a first horizontal groove defined in said exhaust hood;

said tubular sleeve defining an aperture positioned to cooperate with said first horizontal groove; and tightening means to be received within said horizontal groove and said aperture for tightening said exhaust hood relative to said tubular sleeve, enabling said exhaust hood pivotal movement relative to said tubular sleeve.

13. A circular sliver knitting machine according to claim 12 wherein said exhaust hood and support ring are adjustable relative to said plurality of needles in both a vertical and rotational direction.

14. A circular sliver knitting machine according to claim 13 wherein said pair of indexing means comprises a first pair of indexing gauge for indexing the vertical position of said air blowing unit relative to said plurality of needles and a second indexing gauge for indexing the rotational position of said air blowing means relative to said plurality of needles.

15. A circular sliver knitting machine according to claim 14 wherein said first indexing gauge comprises a body connected to said attachment sleeve and plunger extending outwardly therefrom, said plunger engages said tubular sleeve wherein vertical adjustment of said air blowing unit relative to said plurality of needles results in relative longitudinal movement of said plunger and said body so as to indicate the vertical position of said air blowing unit relative to said plurality of needles.

16. A circular sliver knitting machine according to claim 15 wherein said first indexing gauge further comprises a dial located within said body, said dial rotatable about a radially arranged scale corresponding to predetermined increments, such that relative longitudinal movement of said plunger and said body causes rotation of said dial about said radially arranged scale.

17. A circular sliver knitting machine according to claim 15 wherein said second indexing gauge comprises a scale with incremental markings connected to one of said exhaust hood and said attachment means, and a reference pointer located generally transverse to said scale on the other of said exhaust hood and said attachment means, wherein pivotal movement of said exhaust hood relative to said attachment means results in relative movement of said reference pointer and said scale so as to indicate the rotational position of said air blowing unit relative to said plurality of needles.

18. A circular sliver knitting machine comprising:

a frame;

a needle cylinder rotatably supported on said frame;

a plurality of needles supported in said needle cylinder for rotational movement therewith and for vertical movement parallel to the axis of rotation thereof;

a plurality of card units at radially spaced locations along the rotational path of said needle cylinder and radially outward therefrom, to deliver sliver fibers to said needles during the movement thereof, and each of said card units having first suction means attached thereto;

a yarn feeding station adjacent each of said card units for feeding yarn to said needles;

a plurality of sinkers cooperating with said needles for forming the yarn and the sliver fibers into knitted fabric;

an exhaust hood for sucking fiber waste laden air from a central portion of the circular sliver knitting machine;

an air blowing unit connected to said exhaust hood and cooperating with each of said card units for blowing air along a path generally radially outward toward said needles;

means for adjusting said exhaust hood so as to selectively vertically and rotationally adjusting said air blowing unit relative to said plurality of needles; and a first indexing gauge cooperating with said adjustment means for indexing the vertical position of said plurality of air blowing unit relative to said plurality of needles for purposes of readily locating a desired vertical position for said air blowing unit relative to said plurality of needles corresponding to a predetermined pattern to be knit; and a second indexing gauge cooperating with said adjustment means for indexing the rotational position of said air blowing unit relative to said plurality of needles for purposes of readily locating a desired rotational position for said air blowing unit relative to said plurality of needles corresponding to a predetermined pattern to be knit.

19. A circular sliver knitting machine according to claim 18 wherein said adjustment means comprises a generally circular support ring carried by said exhaust hood, said air blowing unit being mounted to said support ring for orienting said air blowing unit relative to said plurality of needles, and said support ring being mounted for movement with said exhaust hood for selectively adjusting said support ring and said air blowing unit relative to said plurality of needles.

20. A circular sliver knitting machine according to claim 18 further comprising attachment means for attaching said exhaust hood to the circular sliver knitting machine, wherein said attachment means comprises:

a tubular sleeve attached to said exhaust hood and said tubular sleeve having a threaded outer surface;

an attachment sleeve attached to the circular sliver knitting machine; and an adjusting ring having a first end longitudinally fixed and rotatably engaging said attachment sleeve for connecting said exhaust hood thereto, said adjusting ring having a second end threadingly cooperating with said threaded outer surface of said tubular sleeve, wherein rotational movement of said adjusting ring about said attachment sleeve and along said threaded outer surface of said tubular sleeve enables longitudinal adjustment of said exhaust hood.

21. A circular sliver knitting machine according to claim 20 further comprising:

a first horizontal groove defined in said exhaust hood;

said tubular sleeve defining an aperture positioned to cooperate with said first horizontal groove; and tightening means to be received within said horizontal groove and said aperture for tightening said exhaust hood relative to said tubular sleeve, enabling said exhaust hood pivotal movement relative to said tubular sleeve.

22. A circular sliver knitting machine according to claim 20 wherein said first indexing gauge comprises a body connected to said attachment sleeve and a plunger extending outwardly therefrom, said plunger engages said tubular sleeve, wherein vertical adjustment of said air blowing unit relative to said plurality of needles results in relative longitudinal movement of said plunger and said body so as to indicate the vertical position of said air blowing unit relative to said plurality of needles.

23. A circular sliver knitting machine according to claim 22 wherein said first indexing gauge further comprises a dial located within said body, said dial rotatable about a radially arranged scale corresponding to predetermined increments, such that relative longitudinal movement of said plunger and said body causes rotation of said dial about said radially arranged scale.

24. A circular sliver knitting machine according to claim 18 wherein said second indexing gauge comprises a scale with incremental markings connected to one of said exhaust hood and said attachment means, and a reference pointer located generally transverse to said scale on the other of said exhaust hood and said attachment means, wherein pivotal movement of said exhaust hood relative to said attachment means results in relative movement of said reference pointer and said scale so as to indicate the rotational position of said air blowing unit relative to said plurality of needles.

* * * * *